United States Patent [19]

Erb et al.

[11] 4,261,511

[45] Apr. 14, 1981

[54] NEBULIZER AND METHOD

[76] Inventors: Elisha W. Erb, 444 Main St., Fitchburg, Mass. 01420; Darrel R. Resch, 18 Campbell Ave., Leominster, Mass. 01453

[21] Appl. No.: 869,734

[22] Filed: Aug. 7, 1978

Related U.S. Application Data

[63] Continuation-in-part of Ser. No. 718,647, Aug. 30, 1976, abandoned.

[51] Int. Cl.[3] ..... B05B 7/04

[52] U.S. Cl. ..... 239/8; 239/338; 239/434; 261/DIG. 39; 261/118

[58] Field of Search ..... 239/5, 8, 25, 338, 405, 239/426, 429–431, 434, 496; 261/DIG. 39, 118

[56] References Cited

U.S. PATENT DOCUMENTS

| | | | |
|---|---|---|---|
| 619,843 | 2/1899 | Schulke | 239/426 X |
| 1,437,201 | 11/1922 | Schumann | 239/431 |
| 2,354,151 | 7/1944 | Skoglund | 239/431 X |
| 2,599,422 | 6/1952 | Yettaw | 239/431 X |
| 2,906,089 | 9/1959 | Kadosch et al. | 239/434 X |
| 3,473,530 | 10/1969 | Urbanowicz | 239/338 X |
| 3,584,792 | 6/1971 | Johnson | 239/338 X |
| 3,774,842 | 11/1973 | Howell | 239/25 |

FOREIGN PATENT DOCUMENTS

| | | | |
|---|---|---|---|
| 559913 | 8/1957 | Belgium | 239/496 |

*Primary Examiner*—Robert W. Saifer

*Attorney, Agent, or Firm*—Thomas L. Tully

[57] ABSTRACT

Pneumatic nebulizer and method for uniformly introducing variable small amounts of flowable liquid into a gas flow to form a stable dispersion having the appearance of a natural fog and consisting essentially of microscopic liquid particles of said liquid dispersed in said gas. The nebulizer comprises a mixing element for introducing the liquid in uniformly fine amounts into the gas flow. The mixing element, which preferably is a replaceable unitary element comprises two contacting members having conforming surfaces which supportingly contact each other over a substantial portion of the surfaces of each to prevent compression therebetween. At least one shallow liquid passage is provided between the members of the mixing element said passage having an entrance in communication with a liquid supply chamber and having an exit orifice in communication with a gas passage to provide at least one stable liquid orifice for metering uniform predetermined amounts of liquid into a gas flowing through said gas passage. Said shallow liquid passage is formed between the said members by providing the surface of one or both members with at least one scratch, grind, etch, impression or the like, or by interposing a discontinuous inert coating or series of spaced shims or other means, to form at least one recess having a depth of about 0.01 inch or less to provide at least one stable, liquid passage for introducing uniform fine amounts of liquid from a liquid supply into the gas passage for admixture with the gas flowing from a gas supply.

49 Claims, 15 Drawing Figures

Figure 5:
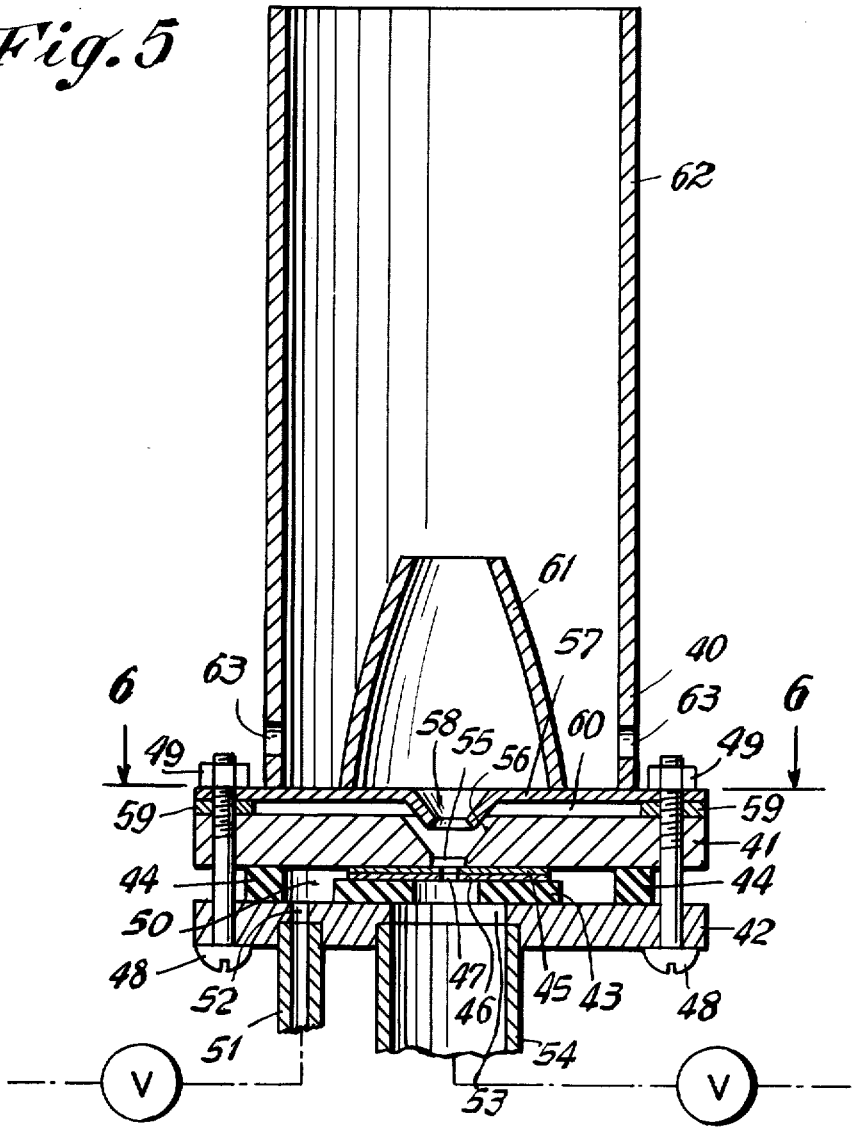

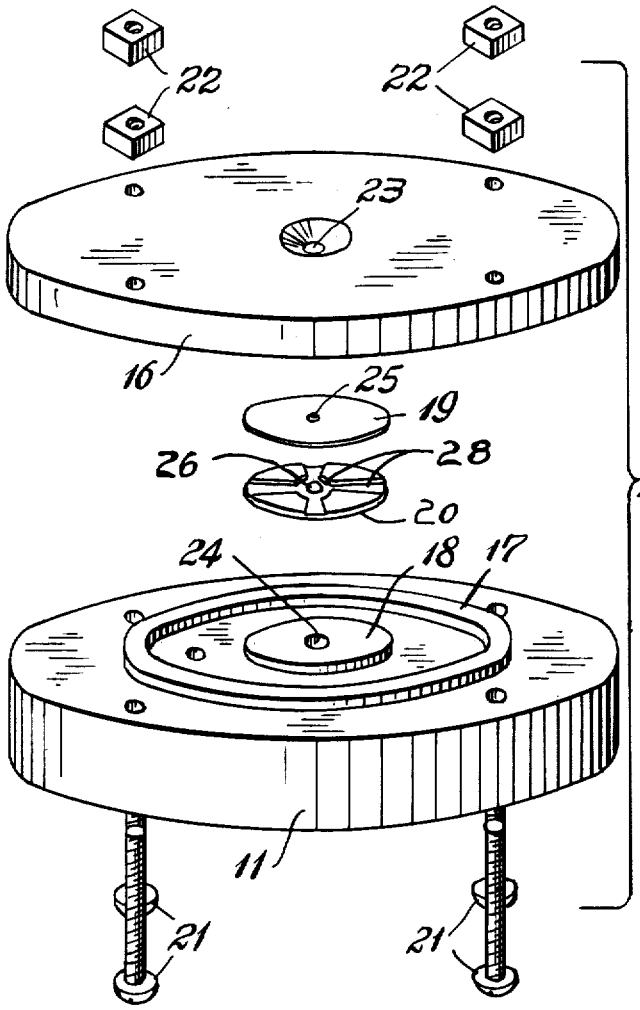
Fig. 1
Fig. 3
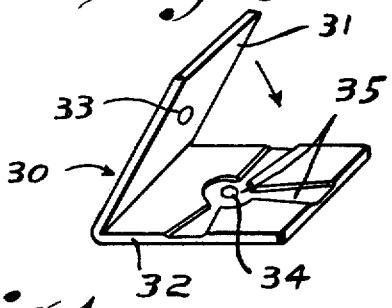
Fig. 4
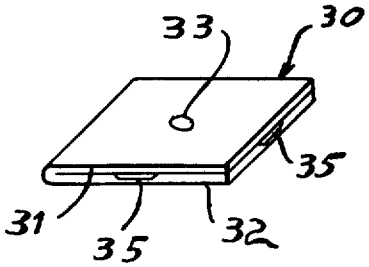
Fig. 2
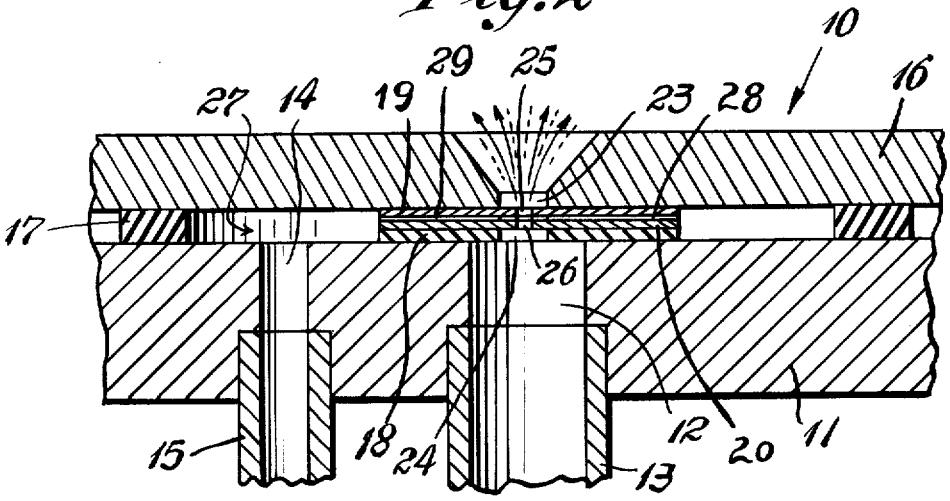

NEBULIZER AND METHOD

The present invention relates to improved pneumatic nebulizers, including fuel burners, carburetors, and to methods, etc., for producing an ultrafine stable dispersion of a flowable liquid in a gas using such nebulizers, and is a Continuation-in-Part of our application, Ser. No. 718,647, filed Aug. 30, 1976, now forfeited.

In general, prior known nebulizer devices are based upon the atomizer principle whereby the propellant gas is forced through a narrow orifice into contact with the liquid which is fed to the outer surface of the orifice either by capillary action or gravity flow.

Such known pneumatic nebulizers have several disadvantages. Most such nebulizers are not effective in providing a fog in which there is not substantial fall-out of liquid unless an impactor, shroud or other barrier is provided in the path of the emitted spray to separate out those dispersed liquid particles having particle sizes above about 50 microns. Such known pneumatic nebulizers cannot directly produce a fog having dispersed liquid particles having a maximum diameter of 20 microns or less. If the spray contains liquid particles larger than about 20 microns in diameter, the fog will strike the impactor and wet its surface, whereas if the spray is free of larger particles, the spray or fog will be carried around the impactor by the propellant and will not wet its surface.

Nebulizers which feed the liquid by gravity or capillary action have the disadvantage that the supply of liquid must be unconfined in order to have access to the gas orifice. Thus, in their basic form, such nebulizers are limited in the extent they may be moved during operation or tilted or inverted or vibrated without causing interruption of the supply of liquid to the gas orifice and cessation of the fog.

Another disadvantage of known gravity-feed and capillary action nebulizers is the inability to control and vary the liquid concentration in the dispersed fog, or such concentration can only be controlled and varied by varying the pressure of the propellant gas. Some nebulizers provide no control means and are unsatisfactory for use in applications where varying concentrations of liquid are required such as for various degrees of humidity, densities of paint, concentrations of fuel, and the like. In other nebulizers, liquid concentration can only be increased by increasing the pressure of the gas flow. This causes a greater volume of the gas to flow out of the nebulizer in a given period of time, which is a disadvantage in the case of confined areas being treated, such as face masks, patient tents, incubators, etc., where the increased gas volume requires compensation.

In other known nebulizers, where both the liquid and the gas are fed under pressure, it is possible to vary the concentration of the liquid by varying the pressure thereof relative to the gas pressure. However such known nebulizers are incapable of producing uniform ultrafine fogs for one or more important reasons. In some such nebulizers the width of the liquid orifice is either too large or is not stable or is adjustable. In the latter case proper adjustment can be made if the operator is experienced but such adjustment may be lost during operation due to the pressures involved or the flexibility of the liquid passage.

The principal object of the present invention is to provide an improved pneumatic nebulizer which is capable of directly and uniformly generating an ultrafine stable fog of liquid particles, preferably having a maximum diameter of about 20 microns or less and having an average diameter of 10 microns or less, in a propellant gas.

Another object of this invention is to provide an apparatus for generating an ultrafine fog of liquid particles in a propellant gas whereby the total weight of the liquid particles for a given weight of the propellant gas can be varied and controlled within close limits independently of the pressure of the propellant gas.

Another object according to one embodiment of the present invention is to provide a pneumatic nebulizer in which all the liquid supplied to the liquid orifice means is nebulized and dispersed as a stable fog, i.e. there is no liquid run-off and no drippage of liquid from the orifice means or from other parts of the nebulizer.

Another object of the present invention is to provide a pneumatic nebulizer having a confined liquid supply whereby the nebulizer may be moved, tilted, inverted or vibrated during use without interrupting the supply of liquid to the propellant gas or interfering with the fog emission.

It is yet another object according to one embodiment of the present invention to provide a pneumatic nebulizer which has a unitary mixing element comprising a fixed liquid passage and a fixed gas passage, preferably having a sharp-edged gas orifice, the relative sizes of said liquid passage and said gas passage being predetermined and fixed, and said mixing element preferably being replacable when worn or contaminated.

Figure 6:
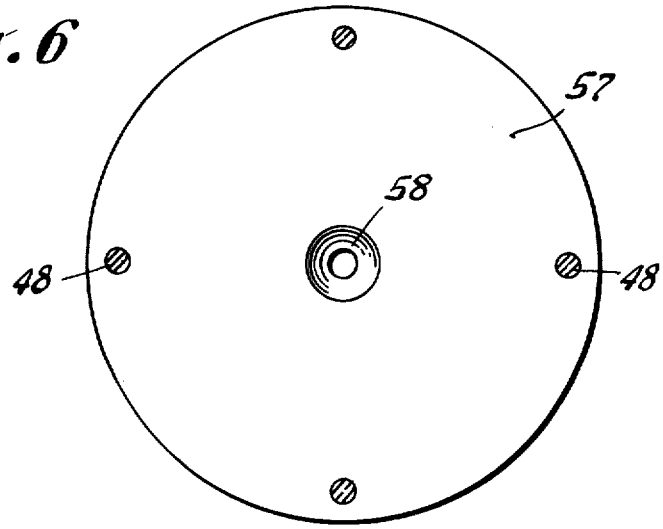

These and other objects and advantages of the present invention will be apparent to those skilled in the art in the light of the present disclosure, including the drawing in which:

FIG. 1 is a perspective view of a nebulizer assembly according to one embodiment of the present invention, the elements thereof being shown spaced for purposes of illustration, FIG. 2 is a diagrammatic cross-section of the nebulizer device of FIG. 1, illustrating the elements in assembled position and in operation, FIGS. 3 and 4 are perspective views of a unitary mixing element suitable for use in the nebulizer assembly of FIG. 1 or of FIG. 5, FIG. 5 is a diagrammatic cross-section of a nebulizer-burner structure according to one embodiment of the invention, FIG. 6 is a plan view of the baffle plate of the nebulizer-burner structure of FIG. 5 taken along the line 6—6, FIGS. 7 to 13 are perspective and side views of various mixing elements suitable for use according to different embodiments of the present invention.

Figure 14:
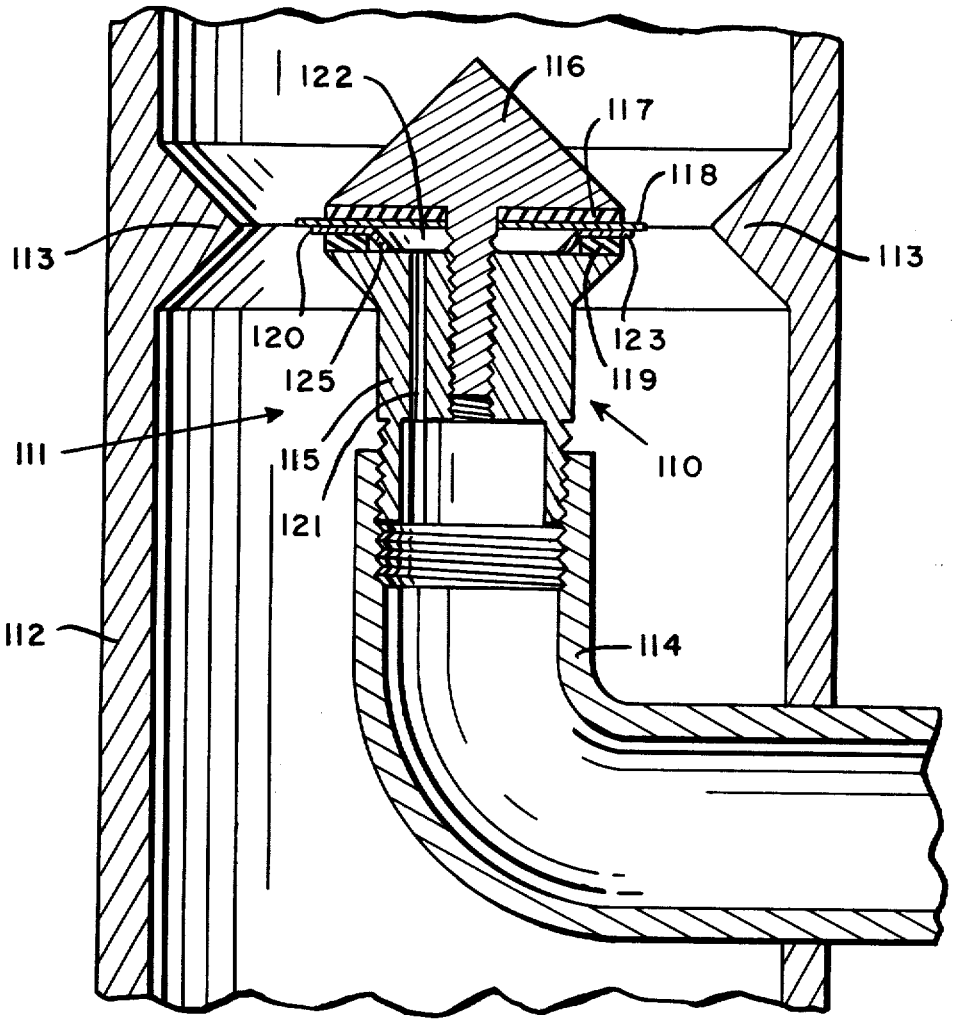
Figure 15:
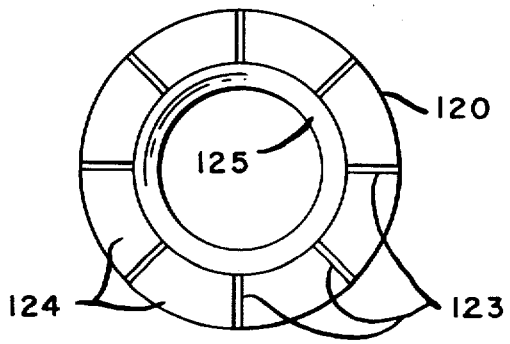

FIG. 14 is a diagrammatic cross-section of a nebulizer-caburetor structure according to yet another embodiment of the present invention, and FIG. 15 is a plan view of the lower ring disc of the nebulizer carburetor of FIG. 14.

The present invention is based upon a number of principles and discoveries which are employed in cooperative manner to provide an improved pneumatic nebulizer which accomplishes the objects and advantages discussed hereinbefore.

The most important discovery is that a liquid which is activated, immediately prior to atomization, by forcing it at a continuous, uniform force through a small stable orifice having the smallest width or diameter which will pass said liquid, i.e. preferably 0.010 inch or less, forms an ultrafine fog of said liquid when released from said orifice into, and preferably at an angle substantially perpendicular to, a flow of gas.

Another related discovery is that if the activated liquid enters the flow of gas substantially simultaneously with the dispersion of said gas flow into a large receptacle or open space, the expansion of the gas disperses the ultrafine fog of said liquid preventing the fine particles of liquid from coalescing into large droplets.

Another related discovery is that the amount of a liquid dispersed in a gas, i.e. the density of the fog created, can be varied and controlled within close limits independently of the pressure or volume of the gas by varying the pressure of the liquid which is fed to the gas flow through a confined stable orifice of restricted and fixed size.

Still another related discovery is that a liquid will not drip from or form droplets beside an orifice having a width of 0.010 inch or less if a constant flow of gas of sufficient velocity is caused to contact the liquid at its exits said orifice and the flow of gas does not thereafter come into contact with any surface.

FIGS. 1 and 2 of the drawing illustrate a unitary nebulizer device adapted to be connected to pressurized sources of a liquid and a gas to cause atomization of the liquid in the form of an ultrafine stable fog. The device 10 comprises a circular base plate 11 having a central opening 12 adapted to be connected to a pneumatic conduit 13 and having an offset opening 14 connected to a liquid-supply tube 15. The base plate 11 is sealingly connected to a circular top plate 16 by means of a compressible outer ring gasket 17 and a compressible inner washer gasket 18 which sealingly confines between itself and the undersurface of top plate 16 circular nebulizer discs 19 and 20. Four bolts 21 and nuts 22 unite plates 11 and 16 with an adjustable pressure, due to the compressibility of gaskets 17 and 18. The plates 11 and 16 and gasket 18 are provided with central openings 12, 23 and 24 respectively, and the nebulizer discs are also provided with central openings 25 and 26 which are smaller in diameter than openings 23 and 24 but larger than 0.01 inch, and which form a restricted gas orifice through which the gas from the pneumatic conduit 13 must pass. All five openings are coaxial to form a gas-flow passage and the flow of the gas through the restricted orifice 26, 25 causes the gas to form a vena contracta at a distance beyond orifice 26 equal to one-half the diameter thereof, and then to expand in a pattern as illustrated by FIG. 2. The sealed confinement of gaskets 17 and 18 between plates 11 and 16 provides a circular chamber 27 to which liquid supplied to the device through supply tube 15 has access.

The circular discs 19 and 20, with their aligned central openings 25 and 26, have conforming surfaces which lie in intimate, substantial sealing engagement with each other over the major portion of the surface areas of each. Lower disc 20 is provided with a shallow recessed area 28, formed by etching or grinding away a thickness of about 0.01 inch or less of the metal from the upper surface of the lower disc or by applying a discontinuous coating or shims having a thickness of about 0.01 inch or less to the lower disc to form spaced raised areas, thereby providing shallow liquid passages 29 between the assembled discs 19 and 20 which extend radially from the periphery of discs 19, 20 and communicate with the central openings 25 and 26, as shown in FIG. 2.

In operation, a gas is supplied under pressure through pneumatic conduit 13 so that it flows forcefully through openings 12, 24, 26, 25 and 23 and exits into the atmosphere, forming a vena contracta and an unobstructed flow pattern as shown by FIG. 2. A liquid is supplied under pressure through supply tube 15 to circular chamber 27 where it is sealingly confined except for escape through the recessed shallow passages 29 comprising recesses 28 between discs 19 and 20, each passage having a small orifice which opens into central disc openings 25 and 26 from several directions. The pressure of the liquid is sufficient to force the liquid through the passages 29 where it is believed to undergo severe "boundary layer turbulence" due to friction with the inner surfaces of the discs 19 and 20 while passing through recesses 28 before escaping into the area of the central openings 25 and 26 of the discs as an excited, very thin film of the liquid having a thickness of less than 0.010 inch, such phenomenon being described in the book *Introduction to Hydraulics and Fluid Mechanics*, by Jones, Harper Bros., New York (1953). Such turbulence causes minute, finite masses of the liquid in the thin film to swirl and eddy in an erratic manner in all directions and with various velocities. As the liquid emerges from the orifice of each passage 29, each of the innumerable, minute, finite masses of the liquid has its own independent velocity and direction.

It is at this point of greatest excitement and turbulence that the thin liquid film exits passages 29 and is exposed to the blast of the gas flow from pneumatic conduit 13. The excited, turbulent liquid film is immediately reduced to an ultrafine dispersion of liquid particles having an average diameter of 10 microns or less and carried through opening 25 by the propellant gas in the form of a stable fog. In the embodiment illustrated by FIG. 2, the thin liquid film enters the gas flow as the gas flow approaches its vena contracta and the liquid is reduced to the ultrafine dispersion. Thereafter the gas expands in a pattern, as illustrated, and flows unobstructed into the atmosphere due to the chamfered structure of orifice 23 of the top plate 16. If orifice 23 was not chamfered the gas flow might strike the inner surface of the orifice depending upon the gas pressure and the thickness of the plate 16. This would cause the dispersed liquid particles to wet said surface and flow back into orifice 25 and would also cause a vacuum to be created in orifice 23 above disc 19.

The discs 19 and 20 of FIGS. 1 and 2 are preferably formed of stainless steel having a thickness of at least about 0.01 inch to prevent flexing of the discs within the recessed areas 28. Because of the supporting contact between the discs the recessed areas 28 and the liquid orifice 29 retain their small spacing regardless of variations in the liquid pressure, thereby maintaining relatively uniform the amount and the thinness of the liquid which is allowed to pass at any given pressure, and insuring the desired end result, i.e. uniform fog, flame or gas feed.

It appears that the improved performance of the present nebulizer devices is due to a number of important cooperative features. First the forcing of the liquid through the shallow recesses 28 between the contacting nebulizer discs 19 and 20 causes the liquid to exit into the area of the central disc openings 25 and 26 as an exceptionally thin film having a thickness of 0.010 inch or less, more preferably a thickness of 0.003 inch or less, as determined by the depth of the recess 28 formed in the disc. The thin liquid film is in a prestressed condition after being forced through the narrow orifice 29 into the area of the central disc openings, in which condition it is capable of being reduced to a multiplicity of extremely fine liquid particles.

A second cooperative feature of the present devices is the provision of a continuous gas flow at an angle to, preferably substantially perpendicular to, the direction of flow of the liquid film, which gas flow passes through the central disc openings and strikes the liquid film as it exits the orifice between the discs. The introduction of the thin liquid film into the gas flow causes the thin liquid film to be blown apart into a multiplicity of microscopic liquid particles having an average diameter of about 10 microns or less which are carried along in the gas flow.

A third cooperative feature of the present device according to a preferred embodiment of the present invention is the abrupt restriction in the gas flow provided by hole 26 in disc 20 which forms a sharp-edged orifice. The gas flow pattern contracts as it flows from the relatively wide area under disc 20 through the relatively narrow area of hole 26 in disc 20. The gas flow pattern continues to contract for some distance beyond disc 20. The point of greatest contraction is known as the vena contracta of the gas flow pattern and is shown in FIG. 2 as the most narrow portion of the illustrated gas flow pattern. The gas flow reaches its greatest velocity at this point of greatest contraction and thereafter the gas flow pattern diverges. Because the gas flow pattern is contracting as it leaves hole 26 in disc 20, none of the molecules of gas which are part of the gas flow come into contact with disc 19 as the gas flow passes through hole 25. This is because holes 25 and 26 are of the same diameter and as the gas flow pttern is contracting as it leaves hole 26; the gas flow pattern will have contracted to a diameter which is slightly smaller than the diameter of hole 25 by the time it passes through hole 25. Because the gas flow flows past orifice 29 at a slight distance from it, the gas does not resist the exit of liquid from orifice 29. The present device may be operated with the fluid pressure in orifice 29 substantially below the gas pressure in opening 12.

A fourth cooperative feature of the present devices, according to a preferred embodiment of the present invention, is the unobstructed passage of the liquid-particle-carrying gas flow into the atmosphere or into a larger chamber being supplied thereby. This is accomplished by excluding from the path of the air flow any portion of the device which could be contacted by the diverging gas flow pattern. Thus if the device has a top plate or other element beyond the central discs, which would normally be contacted by the expanding gas flow the central orifice of such top plate or other element must be sufficiently large or the plate must be sufficiently thin or must be outwardly chamfered, as shown by FIG. 2, to prevent the gas flow from striking the surface of the plate or other element before it escapes into the atmosphere. If the expanding gas flow pattern strikes the surface of the plate or any other solid surface in the vicinity of the disc openings, the dispersed liquid particles will coalesce on that surface and increase in size until the surface becomes wet with the liquid and droplets form thereon. Many of said droplets will be blow off the surface on which they form by the flowing gas, thereby contaminating with relatively large droplets the fine dispersed liquid particles contained in the flowing gas. In addition, if the expanding gas flow pattern strikes the central orifice of the top plate, some of said droplets will run down the sides of the central orifice and onto disc 19, eventually obstructing central opening 25. This is a second source of large liquid particles in the gas flow because the liquid which collects in the area of the central disc opening 25 enters the gas flow and sputters from the area of the central disc opening 25 under the force of the gas flow as sizable droplets.

In cases where the escaping expanding gas flow pattern strikes a surface which is in continuous, closed association with the gas orifice, i.e. with central disc opening 25 of FIGS. 1 and 2, a partial vacuum is created in the area adjacent the vena contracta of the gas flow and this partial vacuum causes the gas flow to diverge faster than it would in open space, with the result that an increased number of the dispersed liquid particles strike the surface, form droplets, etc., as discussed supra. However these disadvantages are avoided, according to the preferred embodiment of this invention, by forming the present nebulizer devices in such a manner that the pattern of the escaping gas flow, containing finely divided liquid particles, is permitted to undergo its normal expansion beyond the vena contracta and into the container or atmosphere being treated without striking any obstruction.

In some instances where the atmosphere being treated is itself contained within a confined receptacle, such as in the case of automobile carburetors, face masks, etc., the advantages discussed above resulting from the unobstructed passage of the liquid-containing gas flow or fog must be compromised to some extent, but in all cases the liquid is in the form of a fine film or jet having a thickness of 0.010 inch or less when the gas flow contacts the liquid. The gas then flows into a larger area so that the gas my expand for at least some distance to permit at least a substantial percentage of the fine liquid particles to become widely dispersed.

As discussed supra the passage of the gas flow from a large space to a confined, narrow space as it passes from the space under disc 20 to the central opening 26 of the nebulizer disc 20 causes the formation of a vena contracta and then a substantial dispersement of the gas flow, with attendant reduction in gas pressure. The thin liquid film or jet is injected into the gas flow in the vicinity of the vena contracta. This appears to cause the already-thin film or jet of liquid to be torn apart by the fast moving gas in the vena contracta with resultant formation of exceptionally fine liquid particles to the apparent exclusion of liquid particles greater than about 20 microns in diameter and probably even to the exclusion of liquid particles greater than about 10 microns in diameter. The liquid particles are immediately dispersed by the expansion of the gas flow beyond the vena contracta. The emitted liquid dispersion has the appearance of a fine, stable fog.

It is an important requirement of the present invention that the gas flow must be continuous and of sufficient velocity that the liquid can be carried away from the area of the disc openings 25 and 26. Preferably the gas and liquid supply are pressurized but this is not necessary in cases where there is a vacuum in the receptacle or atmosphere being treated such as in the case of an automobile manifold. The manifold vacuum creates a suction in the area of the gas orifice and the liquid orifice, causing the gas, i.e. air, to be sucked through its orifice and causing the liquid, i.e. gasoline, to be sucked through its orifice and dispersed into the air flow for dissolution and perfect combustion.

FIGS. 3 and 4 of the drawing illustrate a unitary mixing element 30 comprising a top plate 31 and a bottom plate 32, which may be substituted for lower disc 20 and upper disc 21 of the device of FIG. 1 to provide excellent results. Plates 31 and 32 are folded over each other so that holes 33 and 34 are in fixed alignment, as shown by FIG. 4.

It should be pointed out that the upper disc 19 or plate 31 may be omitted and disc 20 or plate 32 may be used alone in association with the undersurface of top plate 16 of the nebulizer of FIGS. 1 and 2 provided that the central opening 23 of plate 16 has the same diameter as the central opening of said discs, such as opening 26 of disc 20 and opening 34 of plate 32.

The plate 32 of the mixing element of FIG. 3 is provided with recessed areas 35 which may be formed by grinding or etching the upper surface of the plate in the areas shown. The depth of the recessed areas 35 need be just sufficient to admit the fluid between the folded-over plates. The adjustability of the tightness of plates 11 and 16 and the discontinuous intimate surface contact between the major portions of the surface areas of plates 31 and 32 permits the element 30 to be compressed while plates 31 and 32 support each other against compression, as shown by FIG. 2 with respect to discs 19 and 20, so that the depth of the orifice in the recessed areas 35 will be stable, i.e. resistant to change with changes in the pressure applied to the liquid or to the gas.

It appears that the confinement of the liquid as an ultrathin layer between two fixed, contacting, parallel members such as the discs 19 and 20 of FIGS. 1 and 2 and plates 31 and 32 of FIGS. 3 and 4, and the introduction of the liquid in the form of an ultrathin film or jet from orifices having a maximum diameter of 0.010 inch, at the point of contact with a continuous, uniform, expanding pneumatic force, is responsible for the ultrafine size of the resulting liquid particles as all of the liquid is broken into small particles and none of the liquid is broken into particles of larger size, as can occur when the liquid is unconfined or if the gas flow is interrupted or insufficient. Such confinement also permits the present nebulizers to be used in any position in space, including upside down, without any spillage or drippage of the liquid or any interruption of the spray activity. Thus such nebulizers are useful as handheld devices for the spraying of paint, liquid fungicides and fertilizers and other materials where complete freedom of alteration of the spray direction is necessary.

It should be pointed out that regardless of the direction of the spray action, it is preferred that the direction of the flow of the gas be substantially perpendicular to the direction of the liquid as it exits the thin orifice. This causes the vena contracta of the gas to form in a direction perpendicular to the direction of the liquid flow in those embodiments of the present invention which utilize a vena contracta, and produces the finest fog possible with the present devices.

The nebulizer of FIGS. 1 and 2 of the drawing, per se or incorporating the other mixing elements disclosed herein in place of discs 19 and 20, can be adjusted to provide the most perfect ultrafine fog for a wide range of viscosity of the flowable liquid which is being dispensed.

FIG. 5 of the drawing illustrates a nebulizer 40 which is preferred for use as a burner element such as an oil burner or the like. Nebulizer 40 has a base unit which is similar in structure and function to the unit illustrated by FIGS. 1 and 2 of the drawing. Thus the base unit comprises a circular top plate 41, a circular base plate 42, a compressible inner washer gasket 43, a compressible outer ring gasket 44 and a mixing element comprising thin contacting nebulizer discs 45 and 46 which are confined between the inner gasket 43 and the undersurface of top plate 41 in such a manner as to prevent relative movement or slippage therebetween. Discs 45 and 46 are provided with central openings or holes which are aligned to provide a restricted, sharp-edged central gas passage 47.

The plates of the base unit are held together by means of four bolts 48 and nuts 49 which are sufficiently tightened with an adjustable pressure to compress gaskets 43 and 44 and to urge the nebulizer discs 45 and 46 into intimate discontinuous surface contact. The upper surface of lower disc 46 is provided with a series of spaced shallow radial recesses such as grooves or scratches which extend from the outer edge to the central opening and which are up to about 0.01 inch in depth and preferably are about 0.001 inch or less in depth. Alternatively discs 45 and 46 may be as illustrated by FIGS. 3 or 4 or 9 to 13 of the drawing. In all cases the recesses, such as grooves, scratches, depressions, etched areas, uncoated areas, etc., are separated from each other by means of contacting areas of the discs or plates so that the contacting plate surfaces cannot be urged or flexed closer together by means of the gas pressure and so that a multiplicity of liquid orifices are provided between the discs or plates to permit passage of the liquid as ultrathin films or jets. Even if one liquid orifice becomes contaminated and blocked the other liquid orifices will continue to provide passageways for the liquid to the gas orifice.

The assembled lower unit provides a sealed circumferential liquid chamber 50 defined by the space between the inside surface of ring gasket 44, the outer edges of discs 45 and 46 and inner gasket 43 and the inside surfaces of plates 41 and 42. Plate 42 is provided with a hole 52 communicating with chamber 50 and with a liquid supply tube 51 adapted to supply the liquid to be nebulized, such as fuel oil, to chamber 50 under any desired pressure.

Base plate 42 is also provided with a central hole 53 and has attached thereto an air supply conduit 54 adapted to supply air at any desired pressure through hole 53, through disc passage 47, and through the central hole 55 in the upper plate 41, the latter being beveled as shown at 56.

As with the nebulizer of FIGS. 1 and 2, the supply of air under pressure through conduit 54 and liquid under pressure through tube 51 causes the air to pass through restricted gas passage 47 while the liquid passes as a thin film between discs 45 and 46 into the air flow. The liquid is dispersed as a multiplicity of fine particles as it enters the air flow in the area of the vena contracta of the gas within hole 55 of top plate 41.

According to the improved embodiment of FIGS. 5 and 6, the base unit is provided with an overlying baffle plate 57 such as a reflective metallic plate having a central hole 58 in alignment with hole 55 of plate 41, baffle plate 57 being spaced from plate 41 by means of washers 59 to provide an air passage space 60 therebetween which communicates with the atmosphere. Plate 57 is provided with outer holes which communicate with the bolts 48 as shown by FIG. 6, and nuts 49 are applied to secure plate 57 in place.

A combustion cone or chimney 61 is provided over baffle plate 57 in alignment with hole 55 of plate 41, plate 57 serving as the floor of the combustion chamber. Finally, an optional exterior chimney element 62 may be applied, the latter being positioned to extend from the surface of the baffle plate 57 to a height greater than cone 61, as illustrated.

The liquid particle/air flow exits central gas passage 47 and forms a vena contracta which extends above disc 46. The pressure in the vena contracta is substantially less than atmospheric pressure, thereby creating a partial vacuum in the area of hole 55. The air above plate 41 in the vicinity of hole 55 is aspirated into and becomes part of the liquid particle/air flow in the area of its vena contracta. The spacing of baffle plate 57 and top plate 41 permits external atmospheric air to be drawn through air passage 60 therebetween and enter the liquid particle/air flow as the latter exits central hole 55 in plate 41. Baffle plate 57 and air passage 60 permits external atmospheric air to satisfy the partial vacuum created by the liquid particle/air flow and prevents liquid particles and gas located above baffle plate 57 being drawn into the space below baffle plate 57. Thus, when the nebulized liquid, such as fuel oil, is ignited within combustion cone 61, it burns evenly and continuously entirely above baffle plate 57. The fact that baffle plate 57 shields top plate 41 from the flame and the fact that cool atmospheric air is drawn through air passage 60 prevents top plate 41 and discs 45 and 46 from becoming hot.

When the nebulized liquid, such as fuel oil, is ignited, part of it burns above combustion cone 61 and part burns within combustion cone 61, causing combustion cone 61 to become very hot. The heat radiated inward from combustion cone 61 causes the fine particles of liquid fuel oil emerging from central gas passage 47 to vaporize almost instantaneously. The vaporized fuel mixes perfectly in the combustion cone with the air which had passed through central gas passage 47 and the air which had been drawn through air passage 60 into the liquid particle/air flow. The vaporized fuel burns with a uniform, translucent, nonluminous blue flame.

If a heat-resistant enclosure, such as metal chimney 62, is placed over combustion cone 61, as shown in FIG. 5, much of the heat of the flame is radiated to chimney 62, causing the latter to glow red hot. It is necessary to provide a small passage for atmospheric air such as a series of circumferential holes 63 near the base of chimney 62 to permit additional air to be drawn into chimney 62 and maintain an even continuous blue flame in and above combustion cone 61.

Home heating oil (No. 2 fuel oil) was burned at the approximate rate of one pint per hour in a working model of the nebulizer shown in FIG. 5 and the exhaust gas analyzed with a BACHARACH Fyrite $CO^2$ Analyzer. The exhaust gas contained 14.5% $CO^2$ at a BACHARACH Smoke No. between 1 and 2, indicating nearly perfect combustion.

Since much of the air needed for complete combustion is drawn from the atmosphere through air passage 60 into the liquid particle/gas flow exiting central gas passage 47, only a relatively small amount of compressed air is required to supply air conduit 54 with sufficient air to operate the nebulizer shown in FIG. 5 as an efficient fuel burner.

The structure of the nebulizer or burner device of FIGS. 5 and 6 makes it possible to use the device as a relatively small automatic, i.e. electrically-controlled, oil burner capable of burning fuel oil in a very efficient manner at a rate as low as about one pint per hour. This is in contrast to currently-available automatic oil burners which burn a minimum of approximately six pints of fuel oil per hour.

An important advantage of the burner device of FIGS. 5 and 6 is that it is possible to control the ratio of the amount of liquid fuel to the amount of the air (including air drawn from the atmosphere) in the liquid fuel particle/air flow passing into the combustion chamber above baffle plate 57, thereby permitting such ratio to be adjusted for perfect combustion. Home heating oil (No. 2 fuel oil) requires 107 lbs. of air (approximately 1,400 cubic feet at atmospheric pressure) be supplied to the flame for perfect combustion of each gallon of fuel oil burned. Combustion will be incomplete if insufficient air is supplied to the flame. If excess air is supplied to the flame, the flame temperature will be reduced because heat is drawn from the flame to heat the excess air. The rate at which atmospheric air is drawn through air passage 60 into the liquid fuel particle/air flow is directly related to the rate at which the liquid fuel particle/air flow flows from central gas passage 47. Because of this, regulating the rate at which liquid fuel enters the burner device through conduit 51 and regulating the rate at which air enters the burner device through conduit 54 regulates both (1) the rate at which liquid fuel particle/air flow (including air drawn from the atmosphere) enters the combustion chamber above baffle plate 57 and (2) the ratio of the amount of liquid fuel to the amount of air (including air drawn from the atmosphere) in the liquid fuel particle/air flow entering the combustion chamber.

Another important advantage of the burner device of FIGS. 5 and 6 arises from the fact that only a relatively small air pump is required to furnish sufficient compressed air to the burner device to operate the nebulizer and to cause sufficient additional air to be drawn into and mixed with the liquid fuel particle/air flow for complete combustion. This is so because a low pressure zone or partial vacuum is created in the liquid fuel particle/air flow as it exits the nebulizer orifice, due to the creation of a vena contracta, and atmospheric air is sucked into the liquid fuel particle/air flow as it exits the nebulizer. A relatively large air pump is required to operate prior known pneumatic atomizer-type oil burners because all or almost all of the air required for combustion is forced through or around the atomizer or nozzle.

Another important advantage of the burner device of FIGS. 5 and 6 arises from the fact that the nebulizer orifice 47 is spaced from the flame, shielded therefrom by baffle plate 57 and cooled by atmospheric air drawn through air passage 60 and as a consequence remains relatively cool. Many known fuel oil burner nozzles are exposed to heat and encounter problems because the fuel oil remaining in the nozzle when the burner shuts off evaporates leaving troublesome residue.

Yet another important advantage of the burner device of FIGS. 5 and 6 arises from the fact that the burning of the fuel oil occurs partly within the confines of combustion cone 61, causing the cone to become hot. The introduction of the fuel oil/air flow into the interior of the heated cone causes the fine fuel oil particles to almost instantaneously evaporate and mix completely with the air within the cone, promoting hydroxylation of the fuel oil resulting in complete and efficient combustion. In the process of hydroxylation, oxygen from the air reacts with the hydrocarbon molecules of the fuel oil to produce hydroxylated compounds which break down into aldehydes, compounds which burn with a clear blue, soot-free flame.

As can be understood from the foregoing, the mixing element used according to the present invention comprises two cooperating members having aligned transverse holes and having conforming, contacting surfaces, a minor portion of the surface area of one or both members being provided with shallow recesses or interstices forming a small liquid orifice between said members which communicates with a liquid supply chamber and with the aligned transverse holes.

The cooperating members preferably are flat stainless steel plates or discs having a thickness between about 0.005 inch and 0.05 inch. However the members may be of arcuate or other shape provided they have corresponding conforming surfaces which contact each other in supporting engagement over the major portion of their surface areas. Similarly the members may be formed of glass, plastic or other inert, liquid-impervious materials.

The cooperating members may be of similar or different thickness. For instance the top member may comprise plate 16 of FIG. 1 or 2 and disc 19 may be omitted provided that the undersurface of plate 16 conforms to the major portion of the upper surface of disc 20, and hole 23 corresponds in diameter to hole 26 in disc 20.

Also it is not necessary that the recesses formed in the lower disc or plate extend to the periphery thereof so long as it communicates with the liquid supply chamber. For example the lower disc may be provided with a transverse liquid hole, spaced from the transverse gas hole, which communicates with the liquid supply chamber.

Preferably the mixing element comprises a unitary element which is easily removable and replacable and which comprises upper and lower plates or discs which are attached to each other to prevent relative movement or slippage therebetween such as the embodiment of FIGS. 3 and 4 of the drawings. Thus if the mixing element becomes worn or contaminated it can be discarded and replaced with a new one. Attachment of the elements or other means of preventing relative movement or slippage such as illustrated by FIGS. 9 and 10 of the drawings, is most important in cases where the transverse gas holes are not centered in the discs or plates, or where several gas holes are present, whereby alignment can be lost if the discs or plates move relative to each other.

FIGS. 7 to 13 illustrate other forms of mixing elements which can be used according to the present invention.

Figure 7:
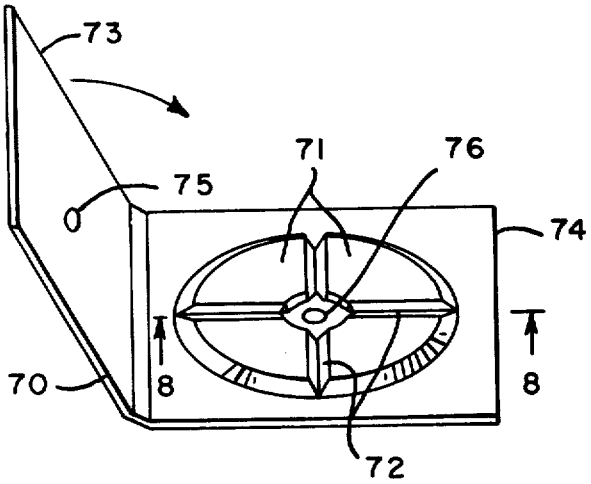
Figure 8:
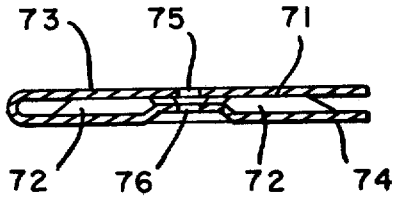

Thus FIGS. 7 and 8 illustrate a unitary mixing element 70 such as a thin stainless steel plate which is folded over in a central position after one end thereof has been pressed to form smooth-surfaced flat raised areas 71 leaving therebetween spaced recesses 72. When the plate is folded over, as shown by FIG. 8, the undersurface of the top plate 73 makes intimate sealing contact with the raised surfaces 71 of the lower plate 74 whereby the only passages therebetween are the shallow recesses 72. In folded-over position the central opening 75 in plate 73 is aligned with the central opening 76 in plate 74 to provide a gas passage which communicates with the recessed areas of the lower plate 74 to receive a thin film of liquid for nebulization.

Figure 9:
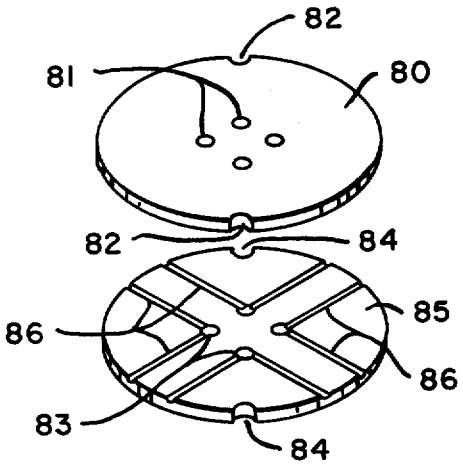
Figure 10:
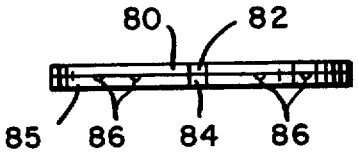

FIGS. 9 and 10 illustrate a mixing element comprising correspondingly notched discs provided with a multiplicity of gas passages. Thus the upper disc 80 comprises four gas openings 81 and two opposed peripheral notches 82 corresponding in size and location to four gas openings 83 and two peripheral notches 84 on the lower plate 85. The gas openings 81 and 83 and the notches 82 and 84 are in alignment with each other when the discs 80 and 85 are assembled, as shown in FIG. 10. The nebulizer device, such as the inner gasket washer 18 of FIG. 1, is provided with means for extending into the aligned notches 82 and 84 to prevent relative slippage or rotation of discs 80 and 85, or this result may be accomplished by the washer 18 per se due to its compressibility in areas adjacent the notches.

As shown, the lower plate 85 is provided with a series of spaced recesses 86 comprising fine scratches which extend from the periphery of disc 85 and communicate with the gas openings 83 to convey liquid from the liquid supply chamber to the gas flow. Obviously, the nebulizer device must be so constructed that all of the gas openings are unobstructed by the gasket 18 and by the central opening 23 of top plate 16.

Figure 11:
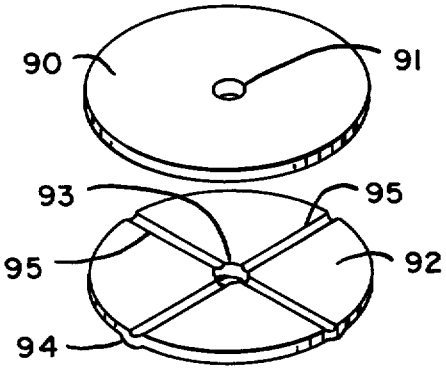
Figure 12:
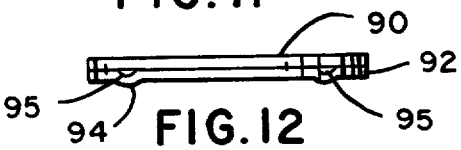

FIGS. 11 and 12 illustrate another mixing element comprising a smooth upper disc 90 having a central gas opening 91 and a lower disc 92 having a central opening 93 and spaced recesses comprising diametric creases or presses 94 which pass through the central opening 93. The creases 94 prevent the disc 92 from lying flat against upper disc 90 in the creased areas so that thin shallow orifice spaces 95 are provided for the passage of the liquid from the liquid supply chamber into contact with the gas flow. The washer gasket 18 of FIGS. 1 and 2 deforms about creases 94 so as to perfectly seal disc 92 to gasket 18 while the upper surface of disc 92, adjacent the creases 94, contacts and sealingly engages the undersurface of upper disc 90.

Figure 13:
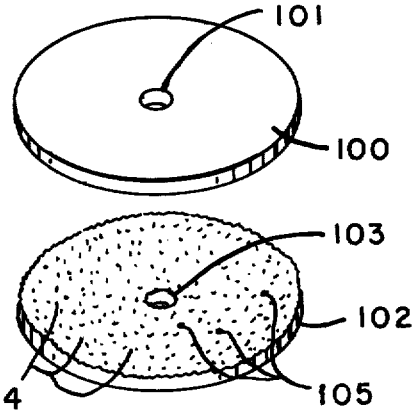

FIG. 13 illustrates yet another mixing element comprising a smooth upper disc 100 having a central gas opening 101 and a lower disc 102 having a central opening 103 and an upper surface comprising a multiplicity of interconnected recessed areas 104 of uniform depth surrounded by a multiplicity of peaks or plateaus 105 of uniform height corresponding to the original thickness of the disc 102. Such disc surfaces may be formed by sandblasting or otherwise chemically or mechanically etching the surface in a uniform and controlled manner whereby the original thickness of the disc is substantially retained in spaced areas or plateaus 105 surrounded by valleys or recessed areas 104 which are interconnected and which extend from the periphery of the disc to the central opening 103, as illustrated. Uniformly roughened surfaces of this type are particularly resistant to becoming clogged because of the myriad of liquid orifices which provide alternative routes or passages for the liquid.

Suitable surfaces of this type may also be formed by pressing the disc against a die having an inversely-corresponding rough surface or, in the case of plastic discs, casting or molding the disc against a casting or molding surface having an inversely-corresponding rough surface.

As an alternative means for forming spaced recesses in the present discs or plates, it is possible to interpose a discontinuous layer of suitable material in a thickness of 0.01 inch or less between the surfaces of the discs or plates rather than removing surface material from the discs or plates. The end result is similar in appearance and function to the disc 20 of FIGS. 1 and 2, for instance, the raised areas surrounding the shallow recessed areas 28 being formed by interposing a uniformly-thin discontinuous coating or shim of inert material such as synthetic resin or metal between the smooth surfaces of the discs. This may be done by applying a coating of a photosensitive resinous composition to disc 20, exposing through a negative and then removing the unexposed areas which will correspond to recessed areas 28, or by vacuum deposition of a metallic layer using a stencil to prevent deposition in the spaced areas which will correspond to recessed areas 28, or by interposing a separate set of inert metal or plastic shims between the discs. A discontinuous coating may also be applied by speckle coating techniques where specks of suitable composition are sprayed onto the surface of the plate or disc to form a multiplicity of spaced peaks of uniform height equal to 0.01 inch or less over the entire surface of the plate or disc. A similar result may be obtained by applying uniformly-sized particles of heat-fusible powder to the disc surface, such as by electrostatic techniques, and then heat-fusing the particles to the disc surface to form spaced peaks which are 0.01 inch or less in height. Also discs or plates cast or otherwise formed with uniformly rough surfaces having recesses of the required depth may also be used. Other suitable methods will be apparent to those skilled in the art in the light of the present disclosure.

FIG. 14 of the drawing illustrates a carburetor nebulizer according to another embodiment comprising a gasoline supply element 110 sealingly engaged within an air flow chamber 111. Chamber 111 consists of a pipe 112, such as a manifold pipe of an automobile engine, having a restricted section 113. The gasoline supply element 110 is mounted within pipe 112 so as to emit gasoline at the restricted section 113 within the pipe.

Supply element 110 comprises a liquid supply conduit 114 which passes through the wall of pipe 112 to a supply of gasoline from outside pipe 112, a restricted flow member 115 which threadably engages the conduit 114, and a conical cap member 116 which threadably engages the restricted flow member 115 to hold the cap member 116 down against the upper surface of the restricted flow member 115.

The underside of the conical cap member 116 is provided with a gasket 117 having attached thereto a thin rigid or pliable disc 118 while the top surface of the restricted flow member 115 is provided with an outer ring gasket 119 having attached thereto a thin rigid or pliable ring disc 120 which is provided with a series of recesses, similar to those present on any of the discs of FIGS. 7 to 13, which provide liquid orifices between discs 118 and 120 having a fixed stable depth of 0.010 inch or less.

In operation, the cap 116 is screwed into flow member 115 to compress gaskets 117 and 119 and urge the surfaces of discs 118 and 120 into intimate surface contact. When the engine is cranked to start, a vacuum is created in chamber 111, drawing gasoline through conduit 114 and air downward through pipe 112. The gasoline is drawn through the passage 121 in restricted flow element 115, into circular chamber 122 and out through the narrow liquid orifice comprising the recesses 123 (shown in FIG. 15) between discs 118 and 120 into the air flow.

The escaping gasoline forms a multiplicity of thin films within the circular space between the restricted section 113 of the pipe 112 and the exits of the liquid orifices 123 and explodes as an ultrafine gasoline fog upon contact with the air flow as the air forms it vena contracta and than expands into the wider chamber of pipe 112 below the restricted pipe section 113.

The ring disc 120, shown more clearly in FIG. 15 preferably comprises flexible stainless steel having a smooth flat contacting surface 124 and a downwardly-tapered centering lip 125. Surface 124 is provided with a multiplicity of evenly-spaced radial grooves or recesses 123 which form the liquid passages or orifices and have a depth of 0.01 inch or less and preferably 0.003 inch or less. Surface 124 makes intimate contact with the undersurface of upper disc 118 of FIG. 14, which is also preferably formed of smooth flexible stainless steel. The periphery of disc 118 projects beyond the periphery of disc 120 and causes the gasoline exiting recesses 123 to be drawn into a fine thin film on the projecting undersurface of disc 118 under the effects of the partial vacuum (air flowing) within the vena contracta of the air flow in the narrow gap between the outer edge of disc 118 and the restricted section 113 of pipe 112. Preferably the width of the narrow gap is adjustable, either by movement of pipe 112, section 113 thereof or supply element 110, so that the velocity of the air flowing past the liquid orifices can be varied independently of the amount of air flowing past the liquid orifices. In the event of contamination of the recessed areas 123, the cap 116 can be unscrewed and the contacting surfaces of discs 118 and 120 can be cleaned. If necessary either or both discs 118 and 120 can be replaced in simple fashion when damaged or worn.

As will be apparent to those skilled in the art, variations may be made in the various structures illustrated by the drawing and the nebulizer mixing elements of one structure may be interchanged with those of the other illustrated structures, obvious slight modifications being made where necessary. Thus the present invention encompasses the use of nebulizer discs or plates which make discontinuous contact with each other over a substantial portion of their surface areas to provide at least one thin liquid orifice therebetween. The discs or plates may be of identical or different thicknesses and function with either a pressurized liquid or gas supply or a vacuum-drawn liquid or gas supply.

The devices of the present invention provide at least one and preferably a multiplicity of very shallow passages of fixed, non-variable depth between contacting discs or plates, each passage and its exit orifice being 0.01 inch or less in depth, and most preferably less than 0.003 inch in depth to restrict the flow of a liquid into a gas flow so that the liquid forms a thin film or jet within the gas flow at a point where the gas is flowing at a substantial velocity. The contact between the present plates or discs over a substantial portion of their surface areas enables them to support each other against flexing together in the areas of the narrow recesses or passages and changing the spacing in such areas, thereby providing stable, small liquid orifices. However, it is noted that the present discs, or at least one thereof, preferably is formed of material such as thin stainless steel which is sufficiently flexible to allow the disc to be mounted in conforming surface contact with the surface of the other disc of the mixing element, yet not so flexible as to enable the disc to collapse in or into the recessed areas. The recessed areas, which form the liquid passages and exit orifices, preferably are narrow in the case of flexible discs to prevent the discs from flexing into or away from the recessed areas. The recesses preferably are 0.1 inch or less in width, and if desired, the width and the depth of the recesses may be about the same. When the exible discs are assembled in surface contact with each other, the recesses present between the surfaces of the plates or discs provide narrow passageways, therebetween, each having a small exit orifice, which narrow passageways are confined between or surrounded by contacting surfaces of the discs or coatings or shims interposed therebetween so as to preclude flexing of the discs in the recessed areas.

It should be understood that the specific structures of the nebulizer devices set forth in the figures of the drawing are not critical except with respect to accommodating the present mixing elements and that variations will be apparent to those skilled in the art for purposes of simplification or modification of the devices to a particular use where size, shape, appearance or other factors are to be considered. For example, the liquid passages and their entrance and exit orifices may be provided in simple and adjustable form by the use of a series of unitary shim elements of different thicknesses, each such element comprising a flexible metal sheet or foil having a thickness of 0.01 inch or less and being provided with one or more radial cut-outs which extend beyond the peripheries of the discs of the mixing element to permit liquid to enter from the liquid compartment, and with a central cut-out which communicates with the radial cut-outs and with the gas orifice to permit the liquid to enter the gas flow. Such shim elements of different known thicknesses may be interchanges for compression between smooth disc elements to provide liquid passages and exit orifices of different precise sizes to provide ultrafine dispersions of different liquids and/or dispersions having different particle sizes.

Variations and modifications may be made within the scope of the claims and portions of the improvements may be used without others.

We claim:

1. A nebulizer device capable of reducing a flowable liquid to an ultrafine dispersion of liquid particles in a propellant gas, comprising a mixing element comprising two superposed members having adjacent surfaces which are supportingly-engaged by each other over a substantial portion of the adjoining surface areas of each, at least one of said members being a flexible member which is pressed into intimate surface contact with a substantial portion of the adjoining surface of the other said members, said contacting members being provided therebetween with at least one shallow passage having a depth of about 0.01 inch or less to form at least one thin liquid conduit between said contacting members, each said passage having an entrance adapted to receive a supply of flowable liquid and having a small liquid orifice which exits into a gas orifice, each said passage being adapted to permit said liquid to pass therethrough and out its liquid orifice to said gas orifice as a thin liquid stream, at least one gas orifice adapted to direct gas flowing therethrough into communication with the liquid flowing from at least one said liquid orifice whereby said flowable liquid which flows through each said thin passage and out of each said small liquid orifice is adapted to form a very thin stream of said liquid which contacts said flowing gas as said gas passes a said gas orifice to form said ultrafine dispersion.

2. A nebulizer device according to claim 1 in which said gas orifice is a restricted sharp-edged gas orifice and said device is devoid of any surface beyond said restricted gas orifice which is capable of being contacted by said ultrafine dispersion.

3. A nebulizer device according to claim 1, in which the depth of each said liquid orifice is less than about 0.003 inch.

4. A nebulizer device according to claim 1 in which said mixing element includes both said gas orifice and said liquid orifice, each of said superposed members having at least one transverse hole which is aligned with a corresponding hole in the other member to form said gas orifice through said mixing element.

5. A nebulizer device according to claim 4 in which each shallow passage extends from the periphery of said member to said transverse hole.

6. A nebulizer device according to claim 1 in which said mixing element comprises at least one removable replaceable recessed member.

7. A nebulizer device according to claim 1 in which the superposed members of said mixing element are attached to each other as a unitary element.

8. A nebulizer device according to claim 1 in which said superposed members comprise a single plate which is folded over onto itself.

9. A nebulizer device according to claim 1 in which each shallow passage comprises an area from which material has been removed from the surface of said member.

10. A nebulizer device according to claim 9 in which each shallow passage comprises an etch made in the surface of said member.

11. A nebulizer device according to claim 9 in which each shallow passage comprises a grind made in the surface of said member.

12. A nebulizer device according to claim 1 in which each shallow passage comprises an impression made in the surface of said member.

13. A nebulizer device according to claim 1 in which each shallow passage comprises the space between a discontinuous inert material interposed between said surfaces.

14. A nebulizer device according to claim 13 in which said discontinuous inert material comprises a discontinuous coating present on the surface of one of said members to form a part thereof.

15. A nebulizer device according to claim 13 in which said discontinuous inert material comprises at least one shim element interposed between and contacted by the surfaces of said members to form a part thereof.

16. A nebulizer device according to claim 1 which further comprises means for varying the rate of flow of said gas through said gas orifice, predetermined variations in the rate of the flow of said gas causing various predetermined amounts of liquid and gas to combine at the gas orifice of said device to produce ultrafine dispersions having variable predetermined concentrations.

17. A nebulizer device according to claim 1 which further comprises means for varying the rate of flow of said liquid through each said liquid orifice, predetermined variations in the rate of flow of said liquid causing various predetermined amounts of liquid and gas to combine at the gas orifice of said device to produce ultrafine dispersions having variable predetermined concentrations.

18. A nebulizer device according to claim 1 in which one of said superposed members of said mixing element extends beyond the other of said members to provide a surface between said liquid orifice and said gas orifice, said surface being adapted to permit the liquid exiting said liquid orifice to be drawn into a thin film thereon during movement of said liquid into said gas orifice.

19. A nebulizer device capable of reducing a flowable combustible liquid such as fuel oil or gasoline to an ultrafine dispersion of liquid particles in a gas flow, such as air, comprising a mixing element comprising two superposed members having adjacent surfaces which are supportingly-engaged by each other over a substantial portion of the adjoining surface areas of each, at least one of said members being a flexible member which is pressed into intimate surface contact with a substantial portion of the adjoining surface of the other of said members, said contacting members being provided therebetween with at least one shallow passage having a depth of about 0.01 inch or less to form at least one thin liquid conduit between said contacting members, each said passage having an entrance adapted to receive a supply of flowable combustible liquid and having a small liquid orifice which exits into a gas orifice, each said passage being adapted to permit said combustible liquid to pass therethrough and out its liquid orifice to said gas orifice as a thin liquid stream, each said gas orifice being adapted to direct a flow of gas therethrough into communication with the thin liquid stream flowing from at least one said liquid orifice to form said ultrafine dispersion, and a combustion compartment adapted to receive said ultrafine dispersion for combustion therein.

20. A nebulizer device according to claim 19 in which said gas orifice comprises a restricted sharp-edged orifice which is adapted to cause said continuous flow of gas to form a vena contracta.

21. A nebulizer device according to claim 20 in which said device is devoid of any surface beyond said restricted gas orifice which in normal operation is contacted by said ultrafine dispersion prior to the combustion of said ultrafine dispersion.

22. A nebulizer device according to claim 19 which further comprises means for varying the rate of flow of said gas through said orifice, predetermined variations in the rate of the flow of said gas causing various predetermined amounts of combustible liquid and gas to combine at the gas orifice of said device to produce ultrafine dispersions having variable predetermined concentrations.

23. A nebulizer device according to claim 19 which further comprises means for varying the rate of flow of said combustible liquid through said liquid orifice, predetermined variations in the rate of flow of said liquid causing various predetermined amounts of combustible liquid and gas to combine at the gas orifice of said device to produce ultrafine dispersions having variable predetermined concentrations.

24. A nebulizer device according to claim 19 in which said combustion compartment overlies said gas orifice and is provided with a floor element having an opening adapted to permit said ultrafine dispersion to enter said combustion compartment, said floor element being spaced from the exit of said gas orifice to provide means for permitting atmospheric air to enter said combustion compartment with said ultrafine dispersion through said opening in the floor element.

25. A nebulizer device according to claim 19 in which the depth of said liquid orifices is less than about 0.003 inch.

26. A nebulizer device according to claim 19 in which said mixing element comprises at least one removable, replaceable recessed member.

27. A nebulizer device according to claim 19 in which the superposed members of said mixing element are attached to each other as a unitary element.

28. A nebulizer device according to claim 19 in which said superposed members comprise a single plate which is folded over onto itself.

29. A nebulizer device according to claim 19 in which each shallow passage comprises an area from which material has been removed from the surface of said member.

30. A nebulizer device according to claim 29 in which each shallow passage comprises an etch made in the surface of said member.

31. A nebulizer device according to claim 29 in which each shallow passage comprises a grind made in the surface of said member.

32. A nebulizer device according to claim 19 in which each shallow passage comprises an impression made in the surface of said member.

33. A nebulizer device according to claim 32 in which said discontinuous inert material comprises a discontinuous coating present on the surface of one of said members to form a part thereof.

34. A nebulizer device according to claim 32 in which said discontinuous inert material comprises at least one shim element interposed between and contacted by the surface of said members to form a part thereof.

35. A nebulizer device according to claim 19 in which each shallow passage comprises the space between a discontinuous inert material interposed between said surfaces on the surface of said member.

36. A nebulizer device according to claim 19 in which said mixing element includes both said gas orifice and said liquid orifice, each of said superposed members having at least one transverse hole which is aligned with a corresponding hole in the other member to form said gas orifice through said mixing element.

37. A nebulizer device according to claim 36 in which each shallow passage extends from the periphery of said member to said transverse hole.

38. A nebulizer device according to claim 19 in which one of said superposed members of said mixing element extends beyond the other of said members to provide a surface between said liquid orifice and said gas orifice, said surface being adapted to permit the liquid exiting said liquid orifice to be drawn into a thin film thereon during movement of said liquid into said gas orifice.

39. Method for reducing a flowable liquid to an ultrafine dispersion of liquid particles in a propellant gas comprising the steps of:

(a) confining a flowable liquid within a chamber having an exit comprising at least one liquid passage;

(b) forming said liquid passage by superposing two members having adjacent surfaces, at least one of said members being sufficiently flexible to permit it to be pressed into intimate surface contact with a substantial portion of the adjoining surface of the other member, and at least one of said contacting members being provided with means for forming between said members, when in contact, at least one shallow passage having a depth of about 0.01 inch or less;

(c) pressing said members together to flex said one member into intimate surface contact with said other member so that said members supportingly engage each other over a substantial portion of the contacting surface areas of each, providing therebetween at least one shallow passage having a depth of about 0.01 inch or less which communicates with said liquid chamber and has a small exit orifice;

(d) causing said liquid to pass from said liquid chamber through said passage between said members and out said small exit orifice as a continuous thin liquid stream having a thickness of less than about 0.010 inch; and (e) causing a continuous supply of gas to flow at sufficient velocity through a gas orifice which communicates with said exit orifice, and against said thin liquid stream to cause said thin stream to be reduced to said ultrafine dispersion of particles of said liquid in said gas.

40. Method according to claim 39 in which a compressible element is superposed with said members and in surface contact with said flexible member in step (b) and adjustable pressure is applied in step (c) sufficient to compress said compressible element against said flexible member to flex said flexible member into intimate surface contact with said other member.

41. Method according to claim 39 in which said flexible member comprises a thin sheet of impervious material which is provided with a multiplicity of continuous fine spaced surface recesses.

42. Method according to claim 39 in which said liquid stream enters said gas flow at an angle substantially perpendicular thereto.

43. Method according to claim 39 in which said liquid stream has a thickness of 0.003 inch or less.

44. Method according to claim 39 in which said liquid is a combustible liquid, and the ultrafine dispersion of step (e) is conveyed to a combustion compartment and burned.

45. Method according to claim 44 in which said liquid is fuel oil and the ultrafine dispersion of step (e) is augmented with air to form a mixture which is conveyed to a combustion compartment and burned.

46. Method according to claim 39 in which one of said contacting members has a surface which extends beyond the other of said members between said exit orifice and said gas orifice, and said liquid is caused to pass out of said exit orifice and to be drawn into a fine thin film on said extension surface during movement of said liquid into said gas orifice.

47. Method according to claim 39 in which said gas orifice is a restricted sharp-edged gas orifice and said continuous flow of gas is forced therethrough so as to cause the formation of a vena contracta in said gas flow, and introducing said continuous thin liquid stream into said continuous flow of gas substantially simultaneously with the formation of the vena contracta of said gas flow to form an ultrafine dispersion of particles of said liquid in said gas.

48. Method according to claim 47 which comprises permitting said ultrafine dispersion of said liquid particles in said gas to be released directly into a larger receptacle without striking any solid surface.

49. Method according to claim 39 which comprises regulating the rate of flow of said liquid and/or of said gas to vary the amount of said liquid passing through said liquid orifice relative to the amount of said gas passing through said gas orifice to vary the amount and/or concentration of said liquid particles dispersed in said gas.

* * * * *